US006502958B1

(12) United States Patent
Chen

(10) Patent No.: US 6,502,958 B1
(45) Date of Patent: Jan. 7, 2003

(54) LIGHT BULB ASSEMBLY ON A SOFT SUPPORT

(76) Inventor: Ching-Huai Chen, 2F-1, No. 152, Nan Yar Street, Hsinchu (TW)

( * ) Notice: Subject to any disclaimer, the term of this patent is extended or adjusted under 35 U.S.C. 154(b) by 0 days.

(21) Appl. No.: 09/965,838

(22) Filed: Oct. 1, 2001

(51) Int. Cl.[7] ..... F21Y 21/00

(52) U.S. Cl. ..... 362/252; 362/249; 362/226; 362/396; 362/806

(58) Field of Search ..... 362/249, 252, 362/226, 396, 806, 430, 457

(56) References Cited

U.S. PATENT DOCUMENTS 5,779,352 A * 7/1998 Lin ..... 362/249
5,791,765 A * 8/1998 Lin ..... 362/249
5,924,786 A * 7/1999 Lin ..... 362/249
6,149,282 A * 11/2000 Huang ..... 362/249
6,161,942 A * 12/2000 Liu ..... 362/249
6,428,184 B1 * 8/2002 Huang ..... 362/226

* cited by examiner

*Primary Examiner*—Laura K. Tso
(74) *Attorney, Agent, or Firm*—Rosenberg, Klein & Lee

(57) ABSTRACT

This invention relates to a bulb assembly on a soft support. The structure includes a bulb connector, a bulb holder, and a bulb, wherein the bulb connector is provided with an extended connecting plate having several branches with end hook. The connecting plate of the bulb assembly can pass through an opening formed on a soft support, and a joint plate has several separated legs and a pair of inward hooks to engage with the branches of the connecting plate that combines the joint plate with the connecting plate together in secure for fixing the bulb assembly on the soft support, while the soft support with the bulb assembly can be easily folded and stored.

2 Claims, 4 Drawing Sheets

LIGHT BULB ASSEMBLY ON A SOFT SUPPORT

A prior decoration of a light bulb string includes a support for connecting with the light bulb assembly thereon to form a specific figure with lighting effect. The known rigid support is facilitated to connect with the bulb assembly but has a fixed large volume. So the rigid support is not convenient to be stored or moved.

The primary object of the invention is to provide a connecting structure for connecting the bulb assembly with a soft support firmly and easily. The complete decoration can display a perfect lighting effect with any specific figure and can be folded to become a small volume for easy storage. Now the features and advantages of the invention will be described in detail with reference to the accompanying drawings.

BRIEF DESCRIPTION OF THE INVENTION

DETAILED DESCRIPTION OF THE INVENTION

Figure 1:
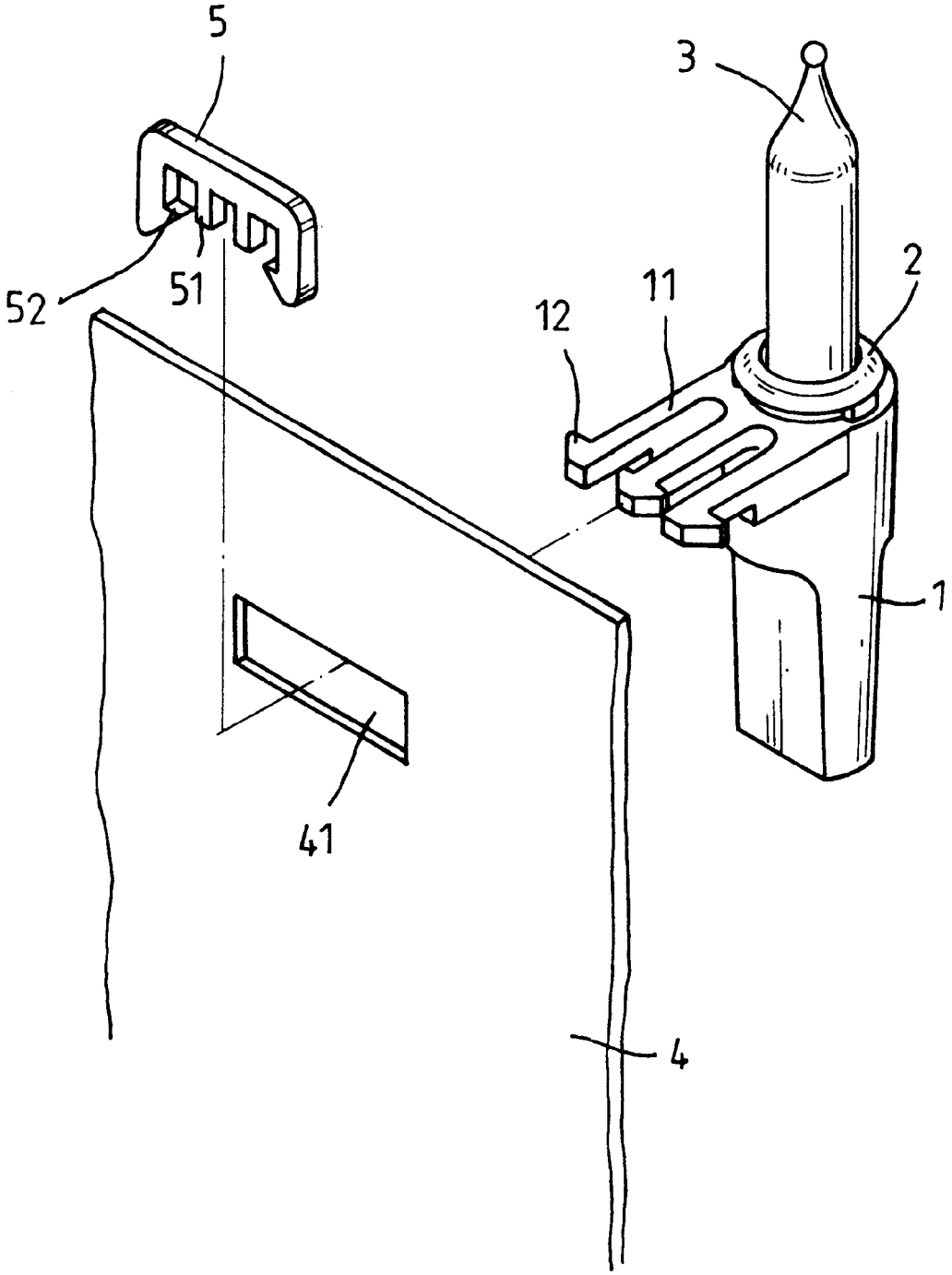
FIG. 1 is an exploded perspective view showing a light bulb assembly with a connecting structure to fix on a soft support according to the invention.
Figure 2:
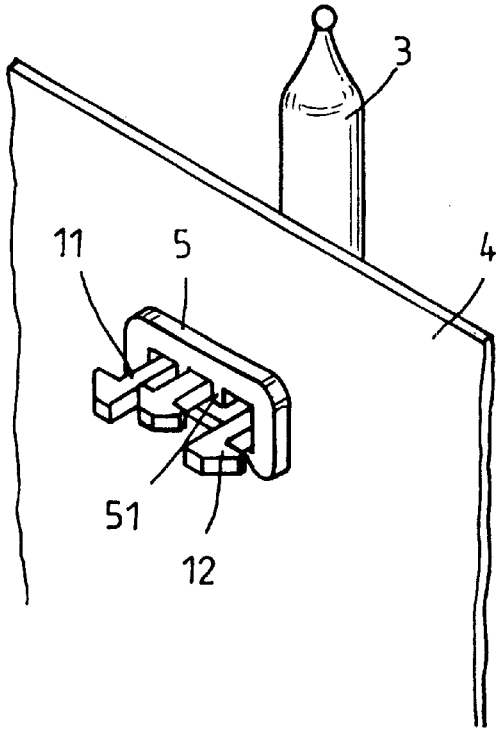
FIG. 2 is an assembled perspective view of FIG. 1.
Figure 3:
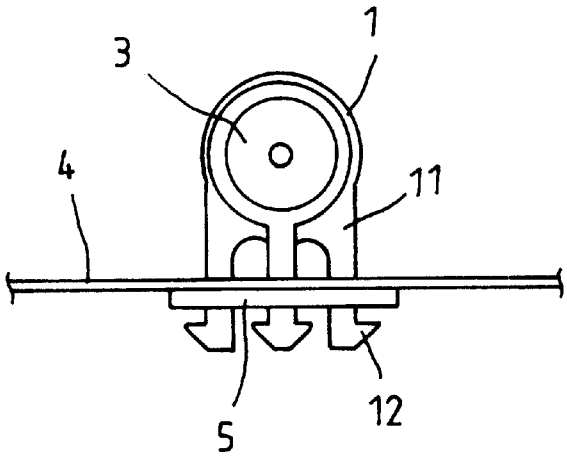
FIG. 3 is a top plan view of FIG. 2.

Please first refer to FIGS. 1 to 3, the present invention comprises a bulb connector (1), a bulb holder (2), and a bulb (3) to become a bulb assembly. The bulb connector (1) is provided with an extended connecting plate (11) having multi-branch with end hook (12). The connecting plate (11) can pass through an opening (41) formed on a soft support (4). A joint plate (5) having several separated legs (51) and a pair of inward hooks (52) to engage with the branch of the connecting plate (1). The joint plate (5) and the connecting plate can be combined securely on the soft support (4) by use of the engagement between the hook (52) and the hook (12). It is to be understood that the bulb assembly can be fixed on the soft support (4) easily and firmly. Each opening (41) can connect with a bulb assembly to become a desired figure for specific decoration based on the design openings.

Figure 4:
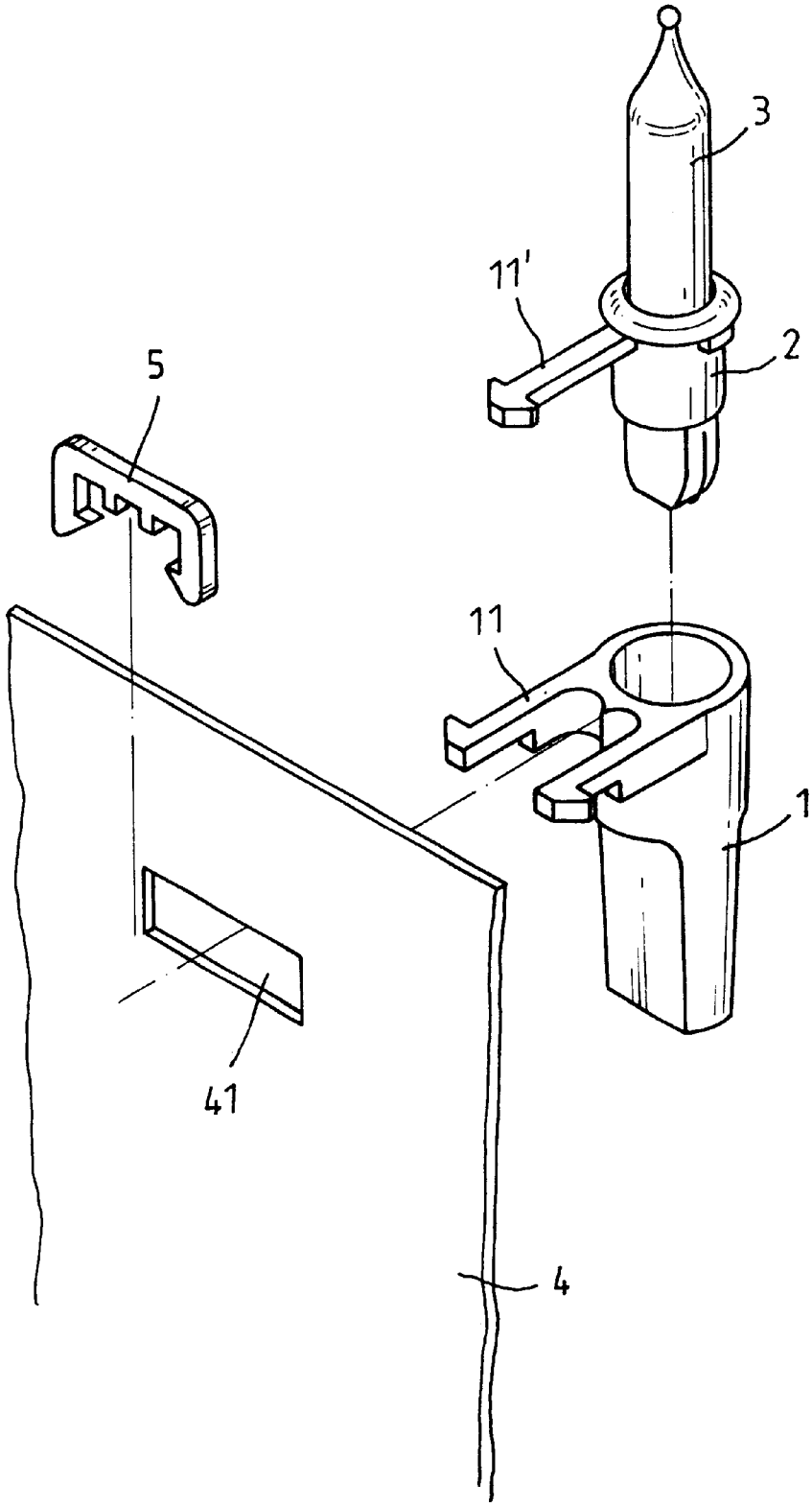
FIG. 4 is an exploded perspective view showing another embodiment according to the invention.
Figure 5:
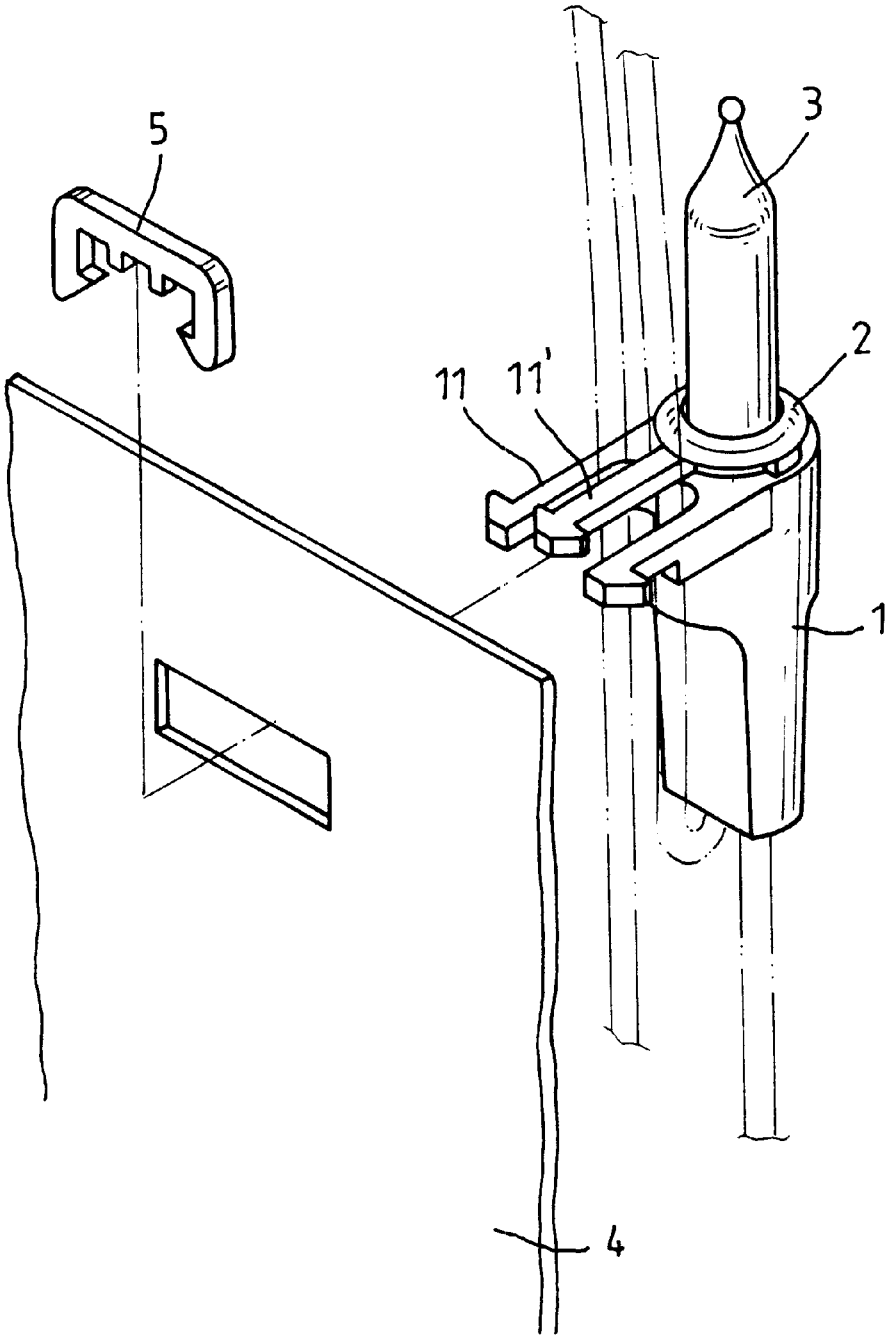
FIG. 5 is a partly assembled perspective view of FIG. 4.

Referring to FIGS. 4 and 5, it shows another embodiment of the present invention, which includes a middle branch of the connecting plate (11') on the bulb holder (2) instead of on the bulb connector (1) having two side branches of the connecting plate (11). After connecting, the bulb assembly obtains a same effect as the above embodiment.

Therefore, the invention is a technical advance. The bulb assembly can be easily fixed on the soft support, which can be facilitated in storage or movement. Evidently it meets the requirements of granting a patent. We hereby file an application for a patent grant.

What is claimed is:

1. A bulb assembly on a soft support including a bulb connector, a bulb holder, and a bulb, wherein the bulb connector being provided with an extended connecting plate having several branches with end hook; the connecting plate of the bulb assembly being through an opening formed on a soft support, and a joint plate having several separated legs and a pair of inward hooks to engage with the branches of the connecting plate that combines the joint plate and the connecting plate for fixing the bulb assembly on the soft support.

2. The bulb assembly on a soft support as claimed in claim 1, wherein a middle branch of the connecting plate is formed on the bulb holder while the rest branches is on the bulb connector, and after the assembly of the bulb holder and the bulb connector, the branches can be engaged with the legs of the joint plate to obtain a firm connection on the soft support.

* * * * *